US011643250B2

(12) United States Patent
Kersley et al.

(10) Patent No.: US 11,643,250 B2
(45) Date of Patent: May 9, 2023

(54) TELESCOPING TWIST AND LOCK PACKAGE WITH ENHANCED USER FRIENDLINESS AND RELIABILITY

(71) Applicant: MOCAP LLC, Park Hills, MO (US)

(72) Inventors: Samuel Joseph Kersley, Sheffield (GB); Lance J. Eftink, Leadington, MO (US)

(73) Assignee: MOCAP LLC, Park Hills, MO (US)

( * ) Notice: Subject to any disclaimer, the term of this patent is extended or adjusted under 35 U.S.C. 154(b) by 0 days.

(21) Appl. No.: 17/707,191

(22) Filed: Mar. 29, 2022

(65) Prior Publication Data

US 2022/0315283 A1 Oct. 6, 2022

Related U.S. Application Data

(60) Provisional application No. 63/168,841, filed on Mar. 31, 2021.

(51) Int. Cl.

| | |
|---|---|
| ***B65D 21/08*** | (2006.01) |
| ***B65D 8/00*** | (2006.01) |
| ***B65D 55/02*** | (2006.01) |
| ***B65D 77/20*** | (2006.01) |

(52) U.S. Cl.

CPC ..... *B65D 21/086* (2013.01); *B65D 11/02* (2013.01); *B65D 55/02* (2013.01); *B65D 77/20* (2013.01)

(58) Field of Classification Search

CPC ..... B65D 11/00; B65D 11/02; B65D 11/18; B65D 11/1866; B65D 11/188; B65D 21/08; B65D 21/086; B65D 77/04; B65D 77/048; B65D 77/20

See application file for complete search history.

(56) References Cited

U.S. PATENT DOCUMENTS

| | | | | |
|---|---|---|---|---|
| 4,046,279 A | | 9/1977 | Rosler | |
| 4,279,355 A | | 7/1981 | Schwartz et al. | |
| 4,596,340 A | * | 6/1986 | Luther | B65D 21/086 220/8 |
| 5,411,161 A | | 5/1995 | Fish, Jr. | |

(Continued)

FOREIGN PATENT DOCUMENTS

| | | |
|---|---|---|
| CN | 305971787 | 8/2020 |
| WO | 1994024008 A1 | 10/1994 |

(Continued)

OTHER PUBLICATIONS

Extendable Plastic Brush Case, Posted at Amaxon.com on Dec. 22, 2020 [site visited Jun. 17, 2022]. Available from internet, URL: <https://www.amazon.com/dp/B08R5RMQKT/> (2020).

(Continued)

*Primary Examiner* — Javier A Pagan
(74) *Attorney, Agent, or Firm* — Armstrong Teasdale LLP

(57) ABSTRACT

A user friendly twist and lock telescoping tubular package includes tubular package pieces with built-in visual cues assisting a user in the proper assembly and operation of the package, and with improved engagement features opposing improper operation of the package while facilitating proper use of the package. Improved locking features are more resistant to inadvertent unlocking or repositioning of the package. Support and stability features enhance the locking connections and improve reliability of the locking connections.

19 Claims, 17 Drawing Sheets

(56) References Cited

U.S. PATENT DOCUMENTS

| | | | | |
|---|---|---|---|---|
| 5,543,186 | A | 8/1996 | Anderson et al. | |
| 5,605,242 | A * | 2/1997 | Hwang | B65D 21/086 220/4.03 |
| 5,606,242 | A | 2/1997 | Hwang | |
| 5,680,949 | A | 10/1997 | Roesler | |
| D397,615 | S | 9/1998 | Nash et al. | |
| 5,829,591 | A | 11/1998 | Lyons | |
| 6,202,876 | B1 | 3/2001 | DeJonge | |
| 6,484,897 | B1 | 11/2002 | Crawley | |
| D558,451 | S | 1/2008 | Roesler | |
| 8,397,911 | B1 | 3/2013 | Bauman | |
| 8,710,958 | B2 | 4/2014 | Yang et al. | |
| 8,789,694 | B2 * | 7/2014 | Roesler | B65D 21/086 206/349 |
| D741,709 | S * | 10/2015 | Sohler | D9/432 |
| 9,211,969 | B2 | 12/2015 | Maze et al. | |
| D748,813 | S | 2/2016 | Ishiguro et al. | |
| 9,296,511 | B2 | 3/2016 | Jones et al. | |
| 9,359,112 | B2 | 6/2016 | Hadar et al. | |
| 9,540,152 | B2 | 1/2017 | Roesler | |
| 9,622,565 | B2 | 4/2017 | Weigel et al. | |
| 9,630,744 | B2 | 4/2017 | Sohler | |
| 9,884,716 | B2 | 2/2018 | Minnette et al. | |
| 9,889,965 | B2 | 2/2018 | Morgan et al. | |
| D827,449 | S | 9/2018 | Roesler | |
| 10,792,120 | B2 | 10/2020 | Whelan | |
| 2006/0086755 | A1 | 4/2006 | Roth et al. | |
| 2006/0191947 | A1 | 8/2006 | Jedryk et al. | |
| 2006/0231444 | A1 | 10/2006 | Roesler | |
| 2007/0012693 | A1 | 1/2007 | Kummer | |
| 2007/0272698 | A1 | 11/2007 | Brown et al. | |
| 2014/0360908 | A1 | 12/2014 | Sorensen et al. | |
| 2015/0003886 | A1 | 1/2015 | Gallardo et al. | |
| 2015/0008153 | A1 | 1/2015 | Ackerman | |
| 2015/0076140 | A1 * | 3/2015 | Roesler | B65D 21/086 220/4.01 |
| 2015/0076149 | A1 | 3/2015 | Roesler | |
| 2015/0344180 | A1 | 12/2015 | Shakoori Divani | |
| 2018/0153277 | A1 | 6/2018 | Domy | |
| 2018/0221836 | A1 | 8/2018 | Ni | |

FOREIGN PATENT DOCUMENTS

| | | | |
|---|---|---|---|
| WO | 2013171749 | A1 | 11/2013 |
| WO | 2018002920 | A1 | 1/2018 |

OTHER PUBLICATIONS

International Search Report and Written Opinion issued for Application No. PCT/US2022/022248, dated Jul. 5, 2022 (12 pages).

* cited by examiner

TELESCOPING TWIST AND LOCK PACKAGE WITH ENHANCED USER FRIENDLINESS AND RELIABILITY

CROSS REFERENCE TO RELATED APPLICATIONS

This application claims the benefit of U.S. Provisional Application Ser. No. 63/168,841 filed Mar. 31, 2021, the disclosure of which is hereby incorporated by reference in its entirety.

BACKGROUND OF THE INVENTION

The field of the invention relates generally to adjustable packages for universal use with objects of different size, and more specifically to telescoping twist and lock packages that are adjustably lengthened or shortened to universally contain elongated objects of different length.

Packaging is known that is adjustable in size to accommodate various different elongated objects having different length. Such packaging generally includes a base piece and a cover piece. The base piece and cover piece include mating interlock features which allow the cover piece to be locked in place in a selected one of different positions relative to the base piece. The lockable cover piece is therefore selectively adjustable in position relative to the base place in order to desirably accommodate different elongated objects inside having respectively different axial lengths. The adjustable nature of the lockable cover piece relative to the base piece is sometimes referred to as a telescoping arrangement wherein fine gradations of locked positions for the cover piece are possible for optimal use of the package with a set of different elongated objects having varied axial length. Such locking telescoping packages can be universally used with different objects of different length and advantageously avoid a need to provide separate, tailor-made or customized packaging for objects of different length. Such telescoping packages can also be provided in various different width and depth dimensions to accommodate packaged objects of various different size in addition to length.

While existing locking telescoping packages of the type described above have been desirably adopted in the marketplace to lower packaging costs and streamline packaging processes for sets of elongated objects having a range of axial lengths compatible with the telescoping packages, certain problems and disadvantages exist. Improvements are accordingly desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
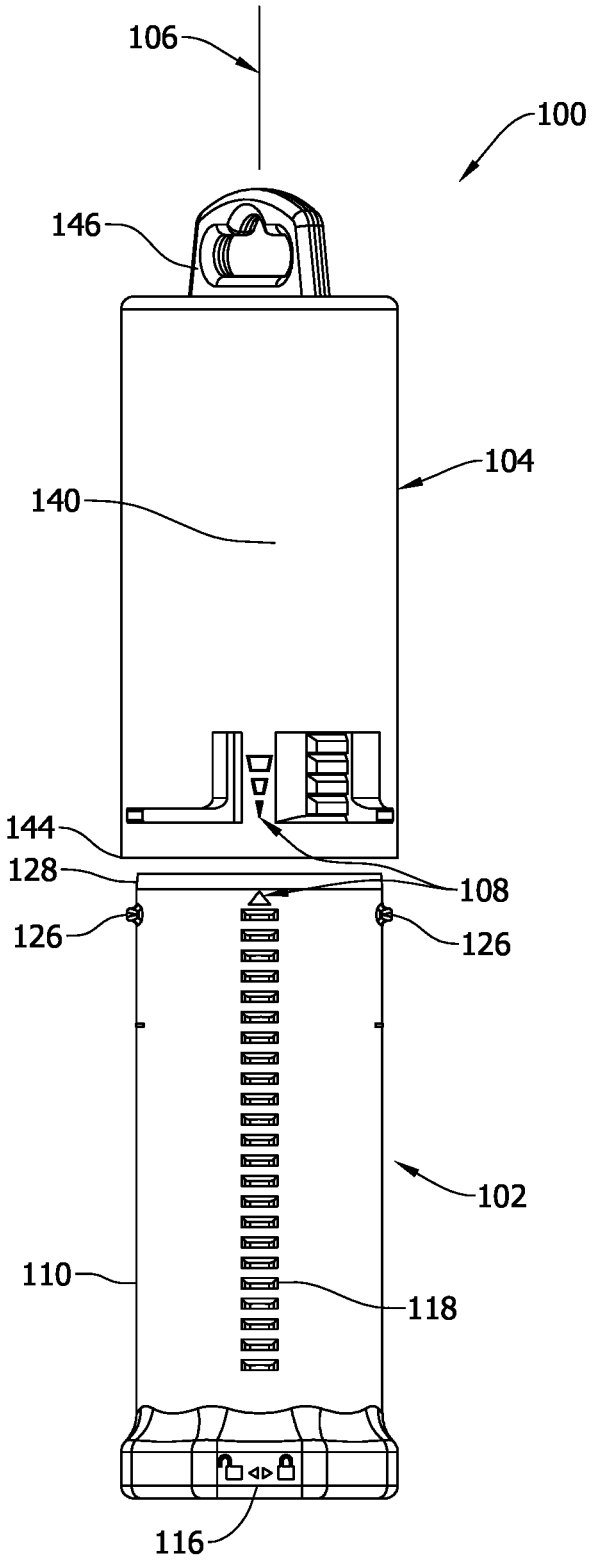
FIG. 1 is a side elevational view of an exemplary telescoping twist and lock package assembly according to a first embodiment of the present invention.

In order to understand the invention to its fullest extent, some discussion of the state of the art of telescoping packages and certain problems in the art is warranted and is therefore discussed below, followed by a description of exemplary embodiments of improved product packages that beneficially overcome the problems in the art.

A variety of different adjustable length product packages are known and in use as a partial solution to unique product packaging needs for certain types of objects that are sold at retail points of sale. Generally speaking, existing adjustable length product packages for sets of elongated objects having respectively different axial length suffer from one or more issues that render them unsatisfactory and disadvantaged in certain aspects.

Firstly, some existing adjustable length product packages can be undesirably complicated from a manufacturing perspective and therefore may be manufactured at undesirably high manufacturing costs. Such complications may, for example, arise from overly complicated shapes of the base and/or cover pieces to achieve the desired adjustability and/or locking. Complicated shapes of base and cover pieces can also introduce difficulties in assembling the base and cover piece, particularly when the assembly requires intricate assembly steps and some level of dexterity to accomplish that not all end users may possess. Lower cost packages with simplified assembly are accordingly desired.

Secondly, some existing adjustable length product packages can be undesirably complicated to use properly. That is, the proper sequence of steps or actions needed to be taken by the end user to adjust the package length to the desired position and securely lock the cover piece in place may be non-intuitive to the end user. Specifically, exactly how to assemble the pieces and/or align the mating features of the base and cover piece to position and lock the cover piece in place may not be evident to the end user, particularly when the mating features are on the interior of the cover piece, and when the mating features on the base are partly or completely obscured to the end user.

For example, in some existing adjustable length packages, it may not be immediately apparent to the user how to correctly assemble the cover piece to the base piece as a general proposition. As such, the user may try to assemble the cover piece to the base piece in the wrong rotational position relative to the base piece, only to have the mating features on the interior of the cover piece interfere with the mating features of the base piece and prevent the telescoping relationship from being established. Trial and error assembly steps may ensue that negatively affect efficiency of packing processes. If a frustrated user attempts to force fit the cover piece to the base piece, damage to the mating features of the cover and base piece may result, undesirably leading to scrapping of the package pieces or reliability issues for the packaging due to damage that may not be evident to the end user when it occurs.

Furthermore, once the telescoping relationship of the cover piece and base piece has been established, it still may not be evident to the end user, because the mating features of the cover piece are obscured, exactly how the user is to adjust the package to achieve the desired axial positioning and locking of the cover piece for a given object to be packaged. Especially when the package is provided to the user with the cover piece pre-assembled to the base piece, the user may experience initial confusion what action is needed to achieve the desired position. For example, the user may not understand whether pushing, pulling, and twisting or rotating the base and/or cover piece in different directions is needed to lock the cover piece in place or unlock the cover piece in order to select another position. As such, some frustrating trial and error may be required by the end user to learn specifically how to adjust the package size to the most desired size and/or to most effectively lock the package in the desired size, creating further inefficiencies in packaging products with optimal sizes of the packages as well as possible damage to the package via attempts to force the cover piece to a desired position. Inefficient assembly and use of the package leads to undesirable increases in labor cost to complete packaging processes, and inadvertent damage to the package results in increase of scrap material and reliability issues. More user friendly packages that can be used with improved efficiency and reliability are therefore desired.

Thirdly, some existing adjustable length product packages can be subject to inadvertent locking and unlocking of the packages during actual use and handling thereof, requiring further steps to unlock or re-lock the packages and introducing further inefficiencies in the packaging of products. Especially for non-intuitive packages of the type described above wherein the locking and unlocking features may not be evident or quickly understood to the end user, the user may inadvertently apply force that changes the position of the package, either from one axial position to another or from locked to unlocked positions or vice-versa. Such inadvertent change in position, and especially an inadvertent unlocking of the package, may in some cases be difficult to correct and detect. Particularly for locking features that are not specifically designed to resist inadvertent unlocking or improper movement of the package pieces and may therefore be dislodged with low amounts of force, inadvertent repositioning of packages may occur that is not realized during handling and use of the package and therefore may result in sub-optimal use of the package. Improved locking features that are less prone to inadvertent repositioning and unlocking of the package are therefore desired.

Fourthly, some existing adjustable length product packages can be subject to mechanical instability in the locked position(s) which can further affect the proper use and reliability of the packages apart from the issues discussed above. In particular, certain types of adjustable length product packages are subject to mechanical play or looseness in the connection of the cover piece and base piece. Among other things, mechanical play may render the package susceptible to a rocking or tilting movement of the cover piece relative to the base piece or vice versa. Such rocking or tilting may undesirably cause an end user to question whether the package has been properly locked and therefore create a perceived quality issue in the package design, not to mention possible attempts to correct the mechanical play in a manner that will not be fruitful but will create further inefficiencies in packaging processes. Such mechanical play in the locked connections may also contribute to unintended or inadvertent unlocking of the package.

Of course, the problems above may be presented in combination in certain types of existing adjustable length product packages and present cascading issues from both the manufacturer and end user perspective. Combinations of the issues above may cumulatively frustrate the fulfillment of longstanding needs in the art for economic and lower cost packing from the manufacturer side while realizing a user friendly, more secure, and more stable packages realizing improved efficiencies in packaging processes to overcome the issues discussed above.

Exemplary embodiments of improved telescoping twist and lock packages are described below that overcome these and other issues in the state of the art. The improved telescoping tubular twist and lock package of the invention advantageously overcomes these and other problems in the art by virtue of: (1) relatively simple and lower cost tubular package pieces with improved locking features; (2) built-in intuitive visual cues to guide user assembly and operation of the packages to improve packaging efficiencies; (3) built-in visual limits for the proper assembly and locking engagement of the package pieces to ensure a full degree of locking engagement and improved locking reliability; (4) built-in visual cues that reveal the interlocking features of the cover piece relative to the base piece in a user-friendly manner; (5) built-in stops and ramps that either oppose improper operation of the package or facilitate operation of the package with relative ease to allow the user to more intuitively understand how to rotate the locking features into secure engagement; and (6) anti-rocking support features built-in to each of the base piece and cover piece to enhance the mechanical support and stability of the interlocked package at a plurality of locations in the mated cover piece and base piece. Method aspects will be in part explicitly discussed and in part apparent from the following description.

FIG. 1 is a side elevational view of an exemplary improved telescoping twist and lock package 100 according to a first embodiment of the present invention. The package 100 includes a generally hollow base piece 102, sometimes referred to as an inner piece, and a generally hollow cover piece 104, sometimes referred to as an outer piece. The base piece 102 and cover piece 104 are each configured to be assembled to one another in an adjustable telescoping relationship relative to one another in a plurality of gradated positions imparting different axial length to the package 100 for optimal use to accommodate objects or items (not shown) having a range of axial lengths that may be fitted inside the package 100 at each respective gradated position. For the purposes herein, the elongated object is considered to fit optimally inside the package when the interior space of the package 100 at the selected one of the gradations positions is closest to but still slightly larger than the actual length of the object to be contained when the object is inside the package 100.

In contemplated embodiments, the object to be contained in the package 100 may reside generally vertically and may therefore be aligned with a longitudinal axis 106 of the package pieces 102, 104 in FIG. 1 (i.e., along a vertical axis in the plane of FIG. 1). The longitudinal axis 106 corresponds to an axial centerline of the base piece 102 and cover piece 104 that respectively coincide when the package 100 is assembled, and the axial length of the object contained in the package may be aligned (i.e., may extend parallel to) or may be misaligned (i.e., may extend at an angle relative to) the longitudinal axis 106. Either way, the package 100 is finely adjustable along the longitudinal axis 106 for use with longer and shorter objects to be contained inside, and this avoids otherwise customized packages with specific length in a one-to-one correlation with objects of different length that are to be packaged.

The adjustability in axial length of the telescoping package 100 along the longitudinal axis 106 beneficially accommodates a range of corresponding axial lengths of objects to be contained in a universal manner inside the package 100. The range of axial lengths of objects to be contained corresponds to a difference between an upper limit defined by the maximum axial length position of the cover piece 104 on the base piece 102 and a lower limit of the minimal axial length of the cover piece 104 on the base piece 102. Within the upper and lower limits of the range, the cover piece 104 may be selectively positioned on the base piece 102 in any one of a large number of intermediate steps or gradations therebetween as described further below.

Figure 2:
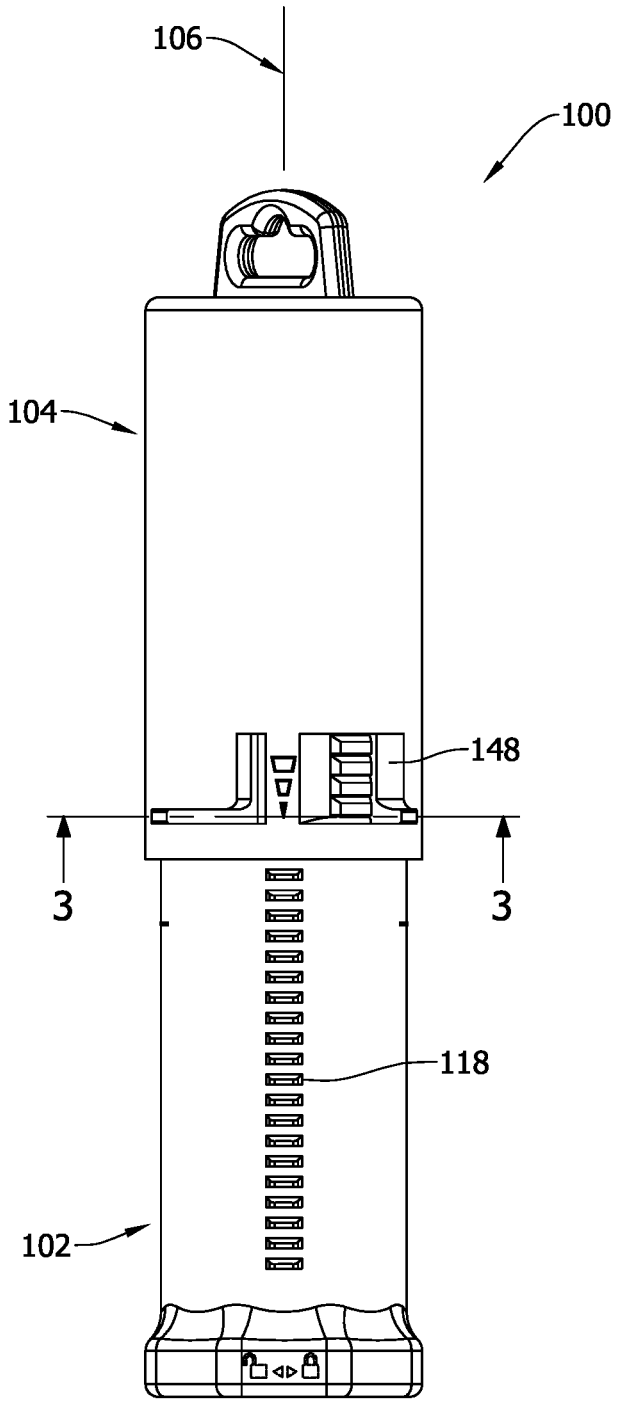
FIG. 2 is an assembled view of the telescoping twist and lock package shown in FIG. 1 in a first telescoping position.

FIG. 2 is an assembled view of the tubular twist and lock package 100 showing an end of the cover piece 104 simply sliding over an end of the base piece 102 in initial assembly of the package 100. Respective directional alignment arrows 108 (FIG. 1) are provided on the distal ends of each of the base piece 102 and cover piece 104 as a visual cue to the user to specifically align the directional arrows 108 in an intuitive manner for initial assembly of the cover piece 104 to the base piece 102. The directional alignment arrows 108, when aligned, indicate the rotational position of the cover piece 104 relative to the base piece 102 (or vice versa) in which the mating locking features of the base and cover piece 104, 102 will not interfere with one another and as such a simple and smooth sliding engagement of the pieces 104, 102 can easily be established. Trial and error assembly of the package 100 is therefore avoided, as well as any tendency of the user to force fit the assembly of the package pieces 102, 104 if the mating features of the package pieces 102, 104 otherwise interfere with one another when the of the package pieces 102, 104 are not properly aligned for initial assembly.

The directional alignment arrows 108 in contemplated embodiments may be raised molded features of the plastic base piece 102 and cover piece 104 that are built-in to the package design. Such built-in design ensures that alignment arrows 108 are reliably visually prominent on each piece 102 and 104 as visual cues to guide the user in the proper assembly of the package 100. The directional alignment arrows 108 may likewise be provided via graphic indicia in the form of applied paint or color enhancement, a sticker or label, or by other means known in the art, albeit such graphic indicia that is not integrated or built-in to the molded package design is subject to wear that can reduce the visual prominence and visual cue for intuitive assembly of the package 100 over time.

In the position shown in FIGS. 1 and 2 with the directional arrows 108 aligned, the cover piece 104 may freely telescope up and down along the axis 106 of the package 100 along an outer surface of the base piece 102 to adjust the relative spacing of the cover piece 104 and the base piece 102 in the axial direction along the axis 106. When so aligned, the inner surface of the cover piece 104 smoothly telescopes over the outer surface of the base piece 102 without restriction in the position shown in FIG. 2. When the desired axial position of the cover piece 104 is obtained relative to the base piece 102, the cover piece 104 may be simply rotated or twisted in a first direction relative to the base piece 102 (or vice versa) about the axis 106 to lock the cover piece 104 in place as shown in one of the gradated positions in the sectional view of FIG. 3 and as further detailed below.

By rotating or twisting the cover piece 104 about the axis 106 in a second direction (opposite to the first direction) relative to the base piece 102 (or vice versa) the cover piece 104 may be unlocked from the gradated position and once again becomes free to telescope along the axis 106 to select another one of the gradated positions. In the position shown in FIG. 2, the cover piece 104 is near the maximum axial length position with the distal end 144 of the cover piece 104 extending at its closest possible to the distal end 128 of the base piece 102 where locking of the cover piece 104 is still possible. The maximum axial length position is sometimes referred to as a fully extended position of the telescoping package pieces 104, 102 and would be used for the longest of the objects to be packaged in the axial length range accommodated by the package 100.

Figure 4:
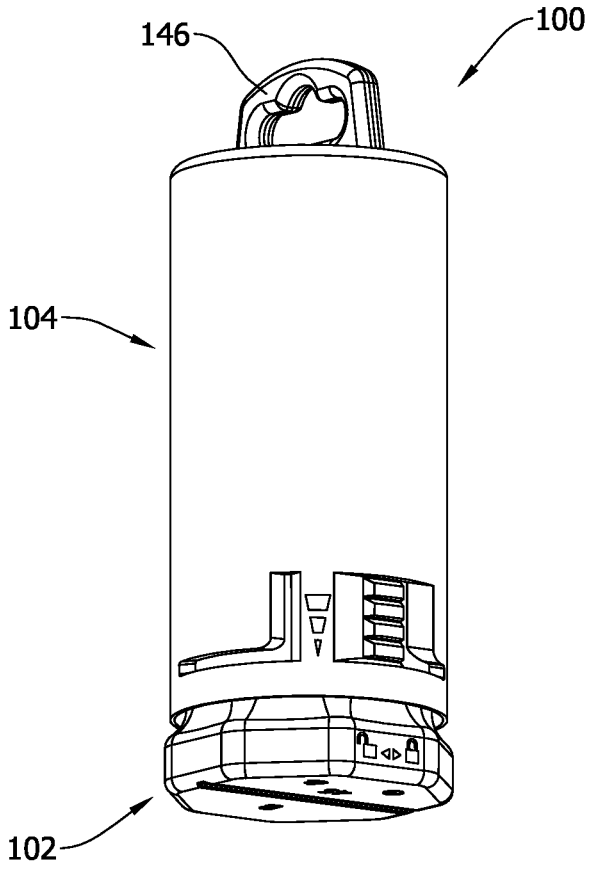
FIG. 4 is a perspective assembled view of the telescoping twist and lock package shown in FIGS. 1 and 2 in a second telescoping position.

FIG. 4 is a perspective assembled view of the package 100 in a second telescoping position that is the minimum axial length position wherein the distal end 144 of the cover piece 104 is at its farthest position possible from the distal end 128 of the base piece 102. The minimum axial length position is sometimes referred to as a fully closed or fully retracted position of the telescoping package pieces 104, 102 and would be used for the shortest of the objects to be packaged in the axial length range accommodated by the package 100. The cover piece 104 is positionable in fine increments between the fully extended position and fully closed position for use with intermediate lengths of the objects to be packaged in between the longest length and the shortest length.

FIG. 5-8 are various views of the base piece 102 which includes an elongated small diameter tubular portion 110 having a generally circular or round cross section, and a truncated larger diameter polygonal or non-round portion 112 at one end of the tubular portion 110. The polygonal portion 112 includes a number of straight of flat sides that are not round, and beneficially provide a sturdy finger grip surface via the flat sides that is simpler for the user to grip and rotate than a round outer surface, while the round outer surface of the tubular portion 110 is not polygonal and therefore provides a smooth and efficient engagement surface for telescoping and locking engagement with the cover piece 104 as further described below. A transition section 114 extends between the tubular portion 110 and the polygonal section 112. The transition section 114 is tapered to gradually expand the round outer diameter of the tubular portion 110 to the larger diameter of the polygonal section 112 over a short axial length along the axis 106.

Directional arrows and lock/unlock indicators 116 are provided in contemplated embodiments on the outer surface of the polygonal portion 112, and in contemplated embodiments the arrows and lock/unlock indicators 116 may be molded and raised, built-in features of the plastic base piece 102 to ensure that they are reliably visually prominent on the base piece 102 for reference by the end user. The directional arrows and lock/unlock indicators 116 may likewise be provided via graphic indicia in the form of paint or color enhancement, a sticker or label, or by other means known in the art, albeit that such graphic indicia is more subject to wear that can reduce the visual prominence and visual cue for reference by the end user over time.

The lock and unlock indictors 116 in the illustrated example are symbolic representations of a closed padlock and an opened padlock, respectively, and therefore provide visual cues which would be intuitively understood by the user in combination with the directional arrows as instructions regarding the directional rotation needed by the user to lock or unlock the package 100 when the base piece 102 and the cover piece 104 are assembled. It is understood, however, that different lock or unlock indicators are possible, including different symbolic representations as well as simple lettering including but not limited to single letter or multiple letter abbreviations of the words "lock and unlock" (or the entire words) as desired. Likewise, symbolic indicators or abbreviations or full use of words other than "lock" and "unlock" may be adopted, such as for example only the words "open" and "close" or "on" and "off" that would also intuitively be understood by the end user as guidance regarding the proper use and operation of the package 100.

In the example shown, pairs of aligned series of lock protrusions 118 are arranged as vertical columns centered respectively at 180° positions on the round outer circumference of the tubular portion 110 and therefore are located opposite to one another just above the directional arrows and lock/unlock indicators 116 in the tubular portion 110. In the illustrated embodiments, each series of lock protrusions 118 includes a number n of lock protrusions such as twenty-three in the illustrated example, although it is understood that the number n of lock protrusions 118 in each series could be greater or smaller in further and/or alternative embodiments as desired or as needed. The lock protrusions 118 are provided in each column at consistent and uniform spacing from one another along the longitudinal axis 106 (FIG. 1) from just above the transition section 114 to near the distal end 128 of the tubular portion 110 extending opposite the polygonal section 112. The lock protrusions 118 are spaced relatively close to another to allow fine incremental spacing and adjustability of the position of the cover piece 104 to adjacent ones of the lock protrusions 118. In the illustrated example, adjacent ones of the lock protrusions 118 are spaced apart from one another in the longitudinal direction (i.e., parallel to and along the axis 106) by about 4 mm in each column as shown in the sectional view of FIG. 7, although larger or smaller spacing of the lock protrusions 118 are possible in further and/or alternative embodiments. Likewise, while two aligned series of lock protrusions 118 are shown and described that are arranged as vertical columns, it is recognized that more than two columns of lock protrusions 118 may be provided in a further and/or alternative embodiment at various different position and spacing relative to one another the round outer circumference of the tubular portion 110.

Figure 8:
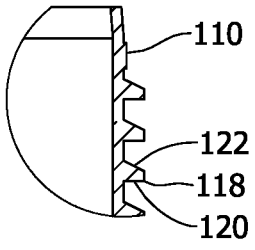
FIG. 8 is a detail view of a portion of FIG. 7.
Figure 9:
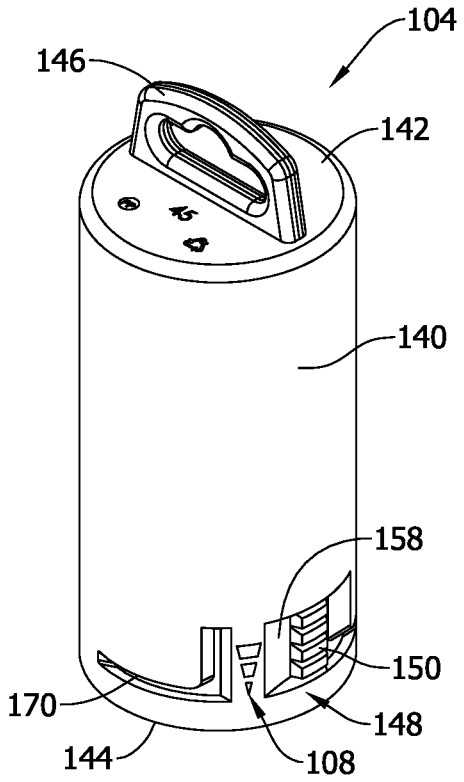
FIG. 9 is a perspective view of an exemplary cover piece for the telescoping twist and lock package illustrated in FIGS. 1-4.
Figure 10:
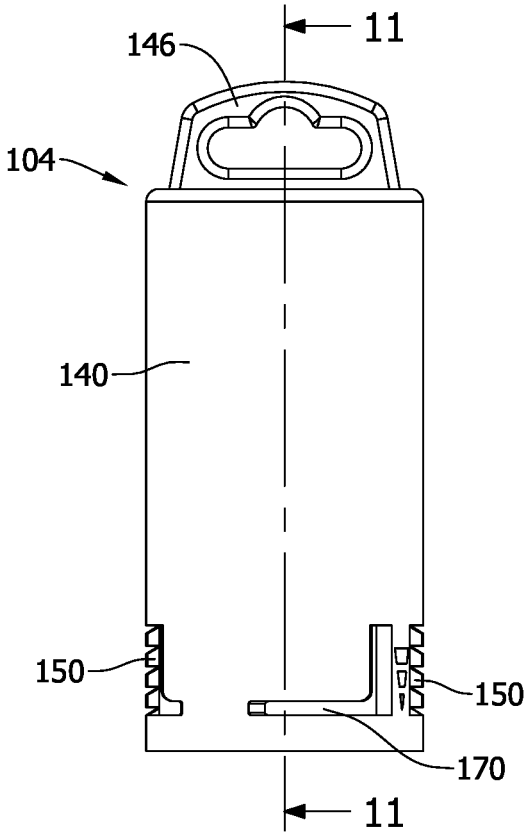
FIG. 10 is a side elevational view of the cover piece shown in FIG. 9.
Figure 11:
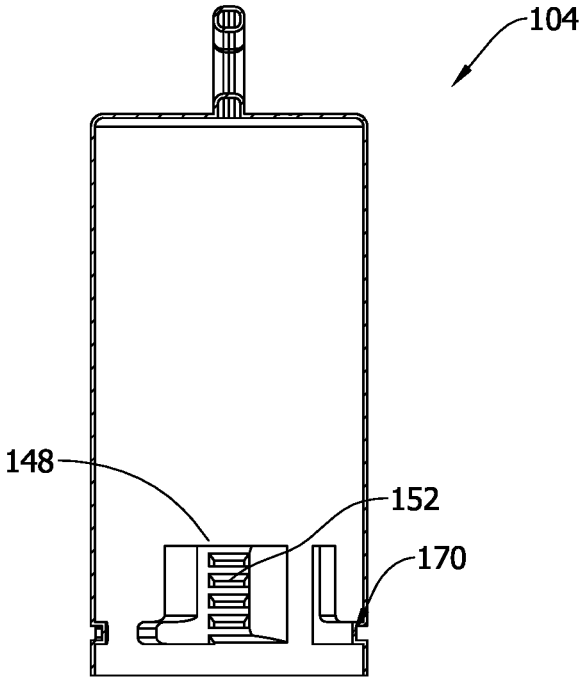
FIG. 11 is a sectional view of the cover piece shown in FIG. 10.
Figure 12:
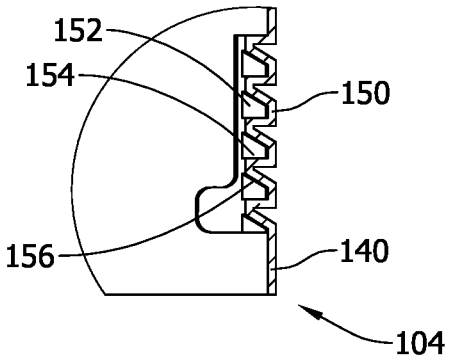
FIG. 12 is a detail sectional view of a portion of the cover piece shown in FIG. 9.
Figure 13:
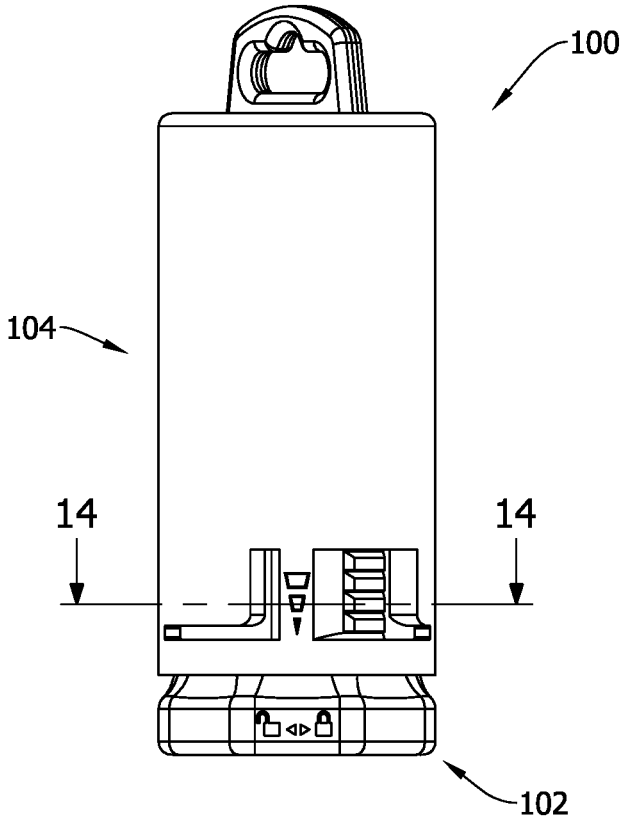
FIG. 13 is a side elevational view of the assembled telescoping twist and lock package shown in FIG. 4 in a freely adjustable state to select a desired axial length of the telescoping twist and lock package.

As best seen in the partial cross-sectional detail view of FIG. 8 showing an axial portion of the base piece 102, each lock protrusion 118 generally includes a flat lock surface 120 extending generally radially and perpendicularly from the round outer surface of the tubular portion 110, and a sloped surface 122 opposite to the flat lock surface 120 that extends at an oblique angle to the round outer surface of the tubular portion 110. As such, the lock protrusions 118 have a generally triangular shape in the views of FIGS. 7 and 8. The lock protrusions 118 are also generally aligned along the vertical axis 106 at each of the 180° positions on the round outer circumference of the tubular portion 110.

In the example shown, the flat lock surfaces 120 of each lock protrusion at each of the incremental step locations of the lock protrusions 118 are co-planar to one another, and the flat lock surfaces 120 of adjacent lock protrusions at each of the 180° positions extend generally in a spaced apart but parallel relationship to one another. In other words the flat lock surfaces 120 of adjacent lock protrusions at each of the 180° positions extend in spaced apart but parallel planes, which in turn extend normally and perpendicularly to the longitudinal axis 106 and also which extend normally and perpendicularly to the round outer surface of the tubular portion 110. As such, the arrangement of the lock protrusions 118 with such flat and parallel lock surfaces 120 is specifically contrasted with threaded locking features having a helical pitch about the axis 106 that is known in some types of existing adjustable length packages. Avoidance of threaded locking features is beneficial as it tends to entail more complicated shapes from the manufacturing perspective, and also requires a more precise assembly of the package pieces.

As seen in FIGS. 1, 2, 3, 5 and 6 the locking protrusions 118 also occupy a very small portion of the circumference of the round tubular portion 110 at each incremental step and elevation of the lock protrusions 118 at each of the 180° positions shown in the round tubular portion 110. As such, the vast majority of the circumference of the round tubular portion 110 is not provided with lock protrusions 118. This too imparts a simpler manufacture relative to existing adjustable packages having more extensive lock features that occupy a larger amount of space and/or require more intricate shapes of the base piece. The circumferential end edges of the lock protrusions 118 are also shown in these figures as having tapered ends with ramped edge surfaces 124 (FIG. 6) that aid engagement with the cover piece 104 as described further below. The shape and geometry of the lock protrusions 118 as described and illustrated is exemplary only and alternative shape and geometry of lock protrusions could be adopted with similar benefits in a further and/or alternative embodiment.

Figure 3:
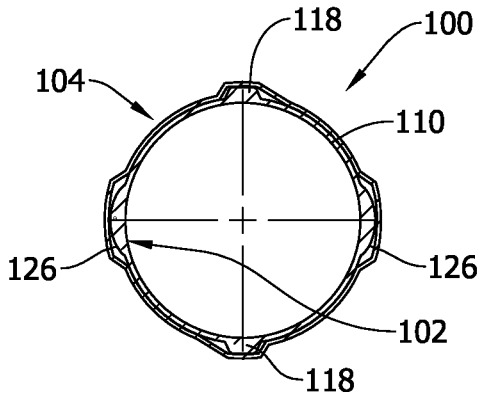
FIG. 3 is a sectional view of the telescoping twist and lock package shown in FIG. 2.

A pair of anti-rocking protrusions 126 extends radially outwardly from the round outer surface of the tubular portion 110 near the distal end 128 of the tubular portion 110 opposite the polygonal portion 112. The anti-rocking protrusions 126 are centered respectively at 180° positions on the tubular portion 110 and are therefore located opposite to one another on the round outer circumference of the tubular portion 110. The 180° positions of the anti-rocking protrusions 126 further reside in between the 180° positions of the columns of lock protrusions 118. As best seen in FIG. 3, the 180° positions of the columns of lock protrusions 118 are centered between the 180° positions of the anti-rocking protrusions 126. As such, and in the view of FIG. 3, the lock protrusions 118 in the respective columns are centered on the 0° and 180° positions on the round outer circumference of the tubular portion 110 while the respective anti-rocking protrusions 126 are centered on the 90° and 270° positions on the round outer circumference of the tubular portion 110. Advantageously, and because of the rotational offset locations of the lock protrusions 118 and the anti-rocking protrusions 126, when the lock protrusions 118 and the anti-rocking protrusions 126 are engaged as described further below, structural support is provided between the base piece 102 and the cover piece at the 0°, 90°, 180° and 270° position and relative movement between the base piece 102 and cover piece 104 such as tilting or rocking movement is generally precluded, if not eliminated at the distal end 128 of the base piece 102.

Figure 5:
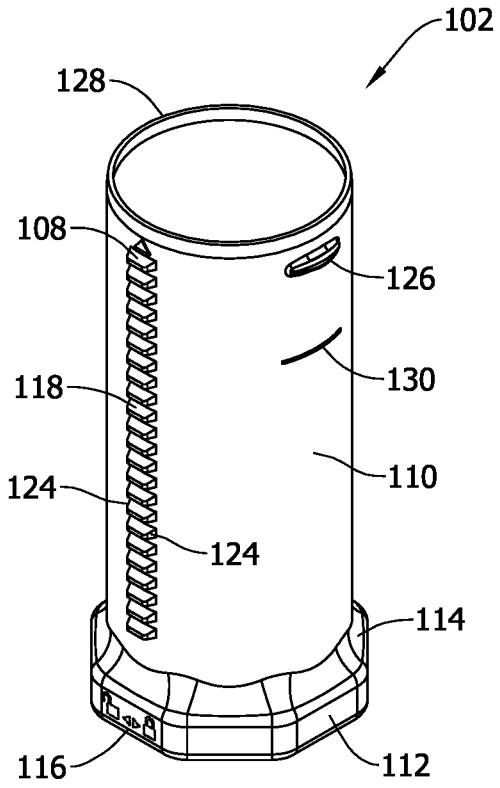
FIG. 5 is a perspective view of an exemplary base piece for the telescoping twist and lock package illustrated in FIGS. 1-4.

As seen in FIGS. 3 and 5 anti-rocking protrusions 126 extend circumferentially on the tubular portion 110 for a greater distance than the lock protrusions 118, and as seen in FIGS. 3 and 5 the anti-rocking protrusions 126 are themselves rounded in their outer surface. Specifically, the outer surfaces of the anti-rocking protrusions 126 have a convex shape with a radius of curvature that is off-centered from the radius of curvature of the round tubular portion 110. The shape and geometry of anti-rocking protrusions 126 as described and illustrated is exemplary only and alternative shape and geometry could be adopted with similar benefits in a further and/or alternative embodiment with similar benefits. Also, while only one pair of anti-rocking protrusions 126 is provided in the illustrated example near the distal end 128 of the base piece 102, more than one pair of anti-rocking protrusions 126 could be provided.

Figure 6:
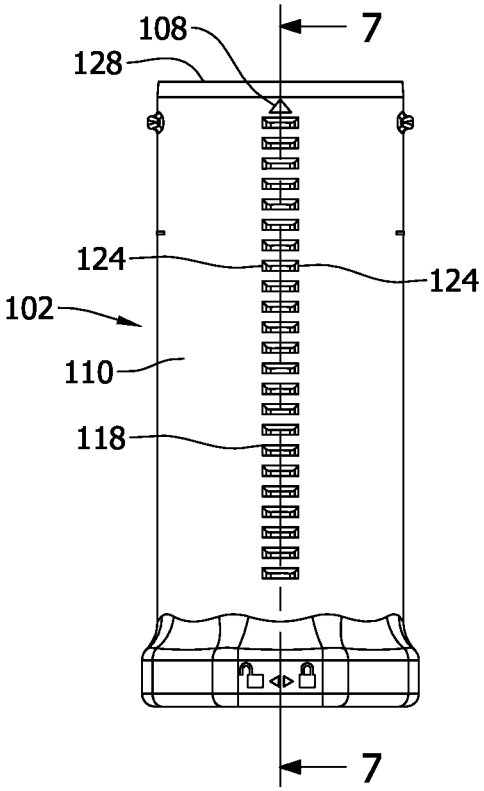
FIG. 6 is a side elevational view of the base piece shown in FIG. 5.
Figure 7:
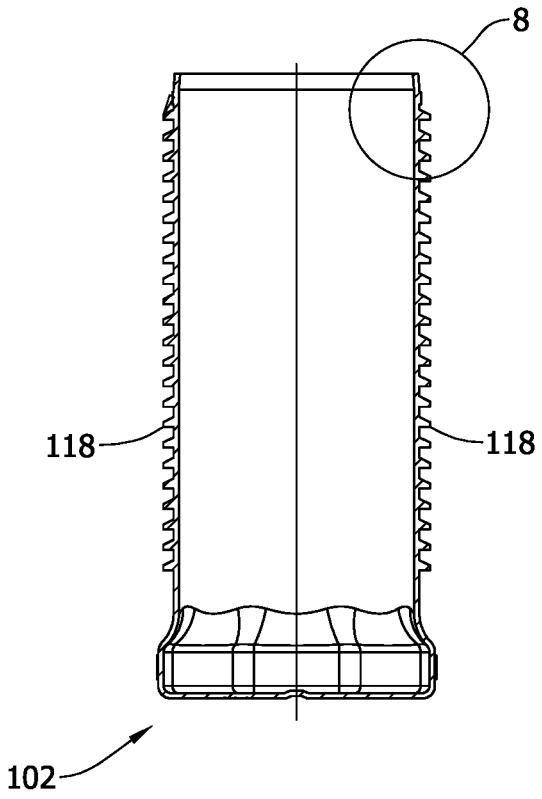
FIG. 7 is a sectional view of the base piece shown in FIG. 6.

As best shown in FIGS. 5 and 6, a pair of circumferential guide lines 130 are formed in the tubular portion 110 extending generally parallel to but spaced from the anti-rocking protrusions 126. In contemplated embodiments the guide lines 130 may be molded, raised, built-in features of the plastic base piece 102 to ensure that they are reliably visually prominent on the base piece 102 as visual cues for reference by the end user. The guide lines 130 may likewise be provided via graphic indicia in the form of paint or color enhancement, a sticker or label, or by other means known in the art, albeit that such graphic indicia is more subject to wear that can reduce the visual prominence and visual cue for reference by the end user over time.

In the use and operation of the package 100, the guide lines 130 may be visually referenced by the end user to identify the most reliable upper limit for the axial position of the cover piece 104 in the package 100 relative to the base piece 102. By aligning the lower distal end of the cover piece 104 with the guide lines 130 and twisting the cover piece and/or the base piece 102 in the lock direction the cover piece 104 can be fully engaged and locked in the most secure manner. Locking of the cover piece 104 can be obtained to a lesser degree above the guide lines 130, but this is not preferred as the cover piece 104 would only be partly engaged to the base piece 102 and therefore would be more likely to undesirably become disengaged. The guidelines 130 therefore desirably provide an intuitive reference point for the end user in identifying the most reliable upper limit of the package extension for secure use thereof.

FIGS. 9-12 are various views of the cover piece 104 that includes an elongated cylindrical tubular portion 140 having a generally circular or round cross section. The diameter of the round tubular portion 140 is a larger than the diameter of the tubular portion 110 of the base piece 102 to facilitate the sliding, telescoping engagement therewith. The tubular portion 140 includes a closed end 142 at the top in the view of FIG. 9, and an open distal end 144 that is inserted over the distal end 128 of the base piece 102 as shown in FIG. 1. The directional arrow 108 is formed in the tubular portion 140 near the open distal end 144 in a segmented manner, and in the example shown the segmented arrow includes a tip or spear section, an intermediate trapezoidal section just above the tip or spear section, and an end trapezoidal section just above the intermediate section that in combination indicate a large arrow pointing toward the distal end 144. The segmented arrow 108 can easily and be intuitively aligned with the arrow 108 on the base piece 102 as described above in the initial assembly of the package 100.

The closed end 142 is formed with a hanger portion 146 allowing it to be suspended on a hanger in a retail product display for purchase of the packaged object. The weight of the package 100 and any object(s) in the package 100 are therefore supported by the hanger portion 146 when the package 100 is vertically hung on the hanger portion 146. While an exemplary shape and geometry of hanger portion 146 is shown in the illustrated embodiment, others are possible and may be adopted in alternative embodiments. In other embodiments, the hanger portion 146 could be considered optional and may be omitted.

The outer surface of the tubular portion 140 is generally smooth and cylindrical and therefore round (i.e., has a circular outer circumference in cross section), but near the distal end 144 is a pair of contoured and recessed interlock portions 148 that are clearly visible from vantage points outside of the cover piece 104. The interlock portions 148 are provided at 180° positions on the circumference of the tubular portion 140 and are therefore located opposite to one another on the round outer surface of the tubular portion 140. Each interlock portion 148 provides a visual cue for the mating features that exist in the cover piece 104 and visually conveys a more intuitive, transparent and readily understood appreciation of how the cover piece 104 actually mates and interlocks with the base piece 102 in use and operation of the package 100.

Specifically, the recessed interlock portions 148 include a series of exterior facing column protrusions 150 that extend flush with the outer surface of the tubular portion 140 but that bear a strong visual resemblance (i.e., are similarly shaped and spaced apart from one another by about the same amount) to the series of lock protrusions 118 on the base piece 102. As such, in the initial assembly as shown in FIGS. 1 and 2, the interlock portions 148 are rotationally offset from the columns of lock protrusions 118 so the user can easily see the relative relations of each piece 102, 104 or both of the pieces 102, 104 needed to align and lock the pieces 102, 104 together via the locking features provided. The number of protrusions 150 in the interlock portion 148 of the illustrated example is much less than the number of protrusions 118 in the base piece 102, and in the illustrated example four protrusions 150 are shown, although greater or lesser number of protrusions 150 can be included in other embodiments. The interlock portions 148 including the protrusions 150 can be interlocked in single step increments determined by the spacing of the lock protrusions 118 in the base piece 102.

The protrusions 150 on the exterior of the round tubular portion 140 define internal recesses 152 (FIG. 11) in the interior of the tubular portion 140 of the cover piece 104. When the locking protrusions 118 of the base piece 102 are received in the recesses 152 the base piece 102 and the cover piece 104 become interlocked to one another. As shown in the detail view of FIG. 12, in the axial direction (i.e., along the vertical direction in FIGS. 10-12) each external protrusion 150 and internal recess 152 in the interlock portions 148 of the cover piece 104 is shaped similarly to but is slightly larger than the lock protrusions 118 on the base piece 102. As such, each external protrusion 150 and internal recess 152 generally includes a flat lock surface 154 extending generally radially and perpendicularly inward from the outer circumference of the round tubular portion 140, and a sloped surface 156 opposite to the flat lock surface 154 that extends at an oblique angle to the outer circumference of the round tubular portion 140. As such, the internal recesses 152, like the lock protrusions 118, have a generally triangular shape. The flat lock surfaces 154, 120 abut one another and stably support the weight of the package 100 when suspended on the hanger portion 146. The abutting lock surfaces 154, 120 resist any tendency of the package 100 to unlock under its own weight, as well as resist and defeat any attempt by a user to pull the cover piece 104 and base piece 102 apart. As such, once the lock protrusions 118 are received in the recesses 152, inadvertent unlocking in the axial direction (i.e., in a direction along the axis 106 of the package 100) is not possible.

As seen in FIGS. 9, 14, 15 and 18 the recessed interlock portions 148 in the cover piece 104 further include a guide wall 158 that defines an axial channel 160 to receive the columns of lock protrusions 118 when the package 100 is assembled. The lock protrusions 118 in the base piece 102 pass through the axial channel 160 such that the base piece 102 is freely movable up and down the axis 106 relative to the cover piece 104. The guide wall 158 is formed with a steep angle side 162 (FIGS. 14 and 15) on one side of the axial channel 160 and a shallow angle side 164 on the other side of the axial channel 160.

Figure 15:
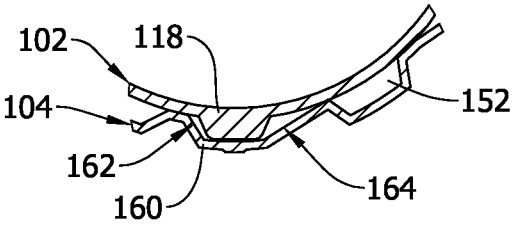
FIG. 15 is a detail view of a portion of FIG. 14.
Figure 16:
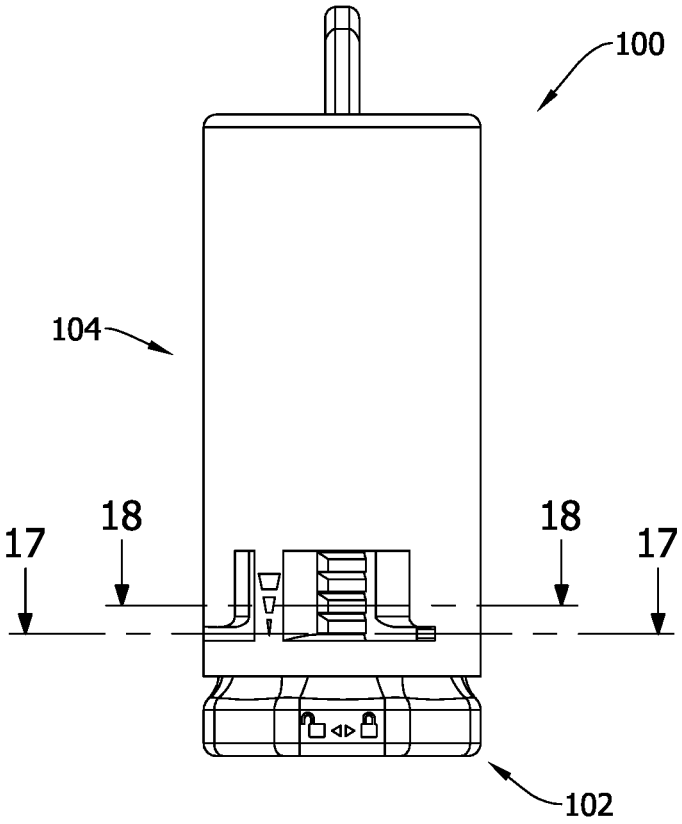
FIG. 16 is a side elevational view of the assembled telescoping twist and lock package shown in FIG. 4 in a locked state to maintain the selected axial length of the telescoping package.
Figure 17:
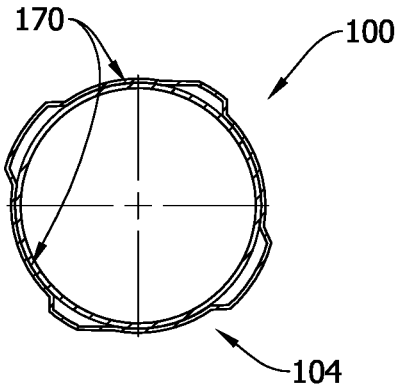
FIG. 17 is a first sectional view of the assembled telescoping twist and lock package shown in FIG. 16 in the locked state.

The steep angle side 162 extends nearly parallel to one of the sloped end edges 124 (FIGS. 5 and 6) of the lock protrusions 118 and provides a hard stop surface to resist an attempt by the user to rotate the cover piece 104 or the base piece in the wrong direction (i.e., a direction causing the lock protrusions 118 to move in a rotational direction away from the lock recesses 152). In the example of FIG. 15, the steep angle side 162 generally prevents the lock protrusion 118 from being released from the guide channel 160 in the clockwise direction by providing a high initial resistance to movement of the lock protrusion 118. In contrast, however, the shallow angle side 164 provides initial low resistance to movement of the lock protrusion 118 toward the lock recess 152, allowing the user to more easily lock the cover piece 104 into a desired position on the base piece 102.

Figure 14:
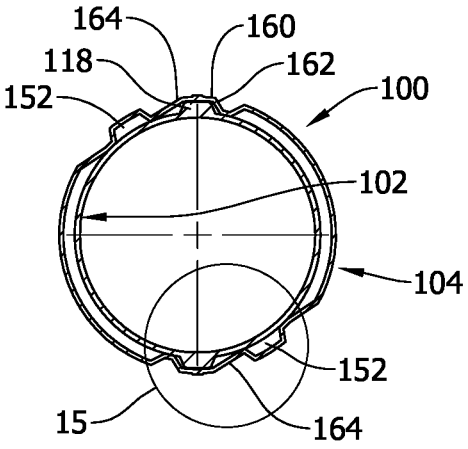
FIG. 14 is a sectional view of the telescoping twist and lock package shown in FIG. 13 in the freely adjustable state.

As shown in the top portion of FIG. 14, for example, the steep angle side 162 and the shallow angle side respectively have unequal slope, and also opposite slope to one another on the opposing sides of the lock protrusion 128. More specifically, the steep angle side 162 has negative slope while the shallow angle slide 164 has positive slope in the top portion of FIG. 9, and relative to one another the steep angle side 162 has a sharp incline while the shallow angle side 164 has a gentle incline. The gentle incline of the shallow angle side 164 imparts a relatively longer length along the incline to reach the outer circumference of the base piece 102, while the sharp incline of the steep angle side 162 imparts a relatively shorter length along the incline to reach the outer circumference of the base piece 102. The incline of the steep angle side 162 extends nearly radially to the outer circumference of the base piece 102, while the shallow angle side 164 extends nearly tangentially in the example illustrated.

Figure 18:
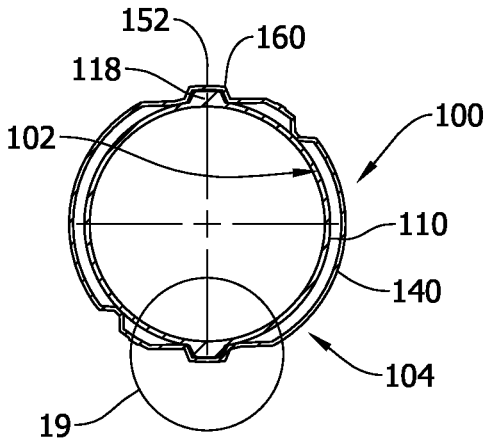
FIG. 18 is a second sectional view of the assembled telescoping twist and lock package shown in FIG. 16 in the locked state.
Figure 19:
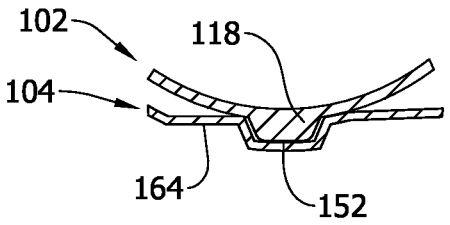
FIG. 19 is a detail view of a portion of FIG. 18.
Figure 20:
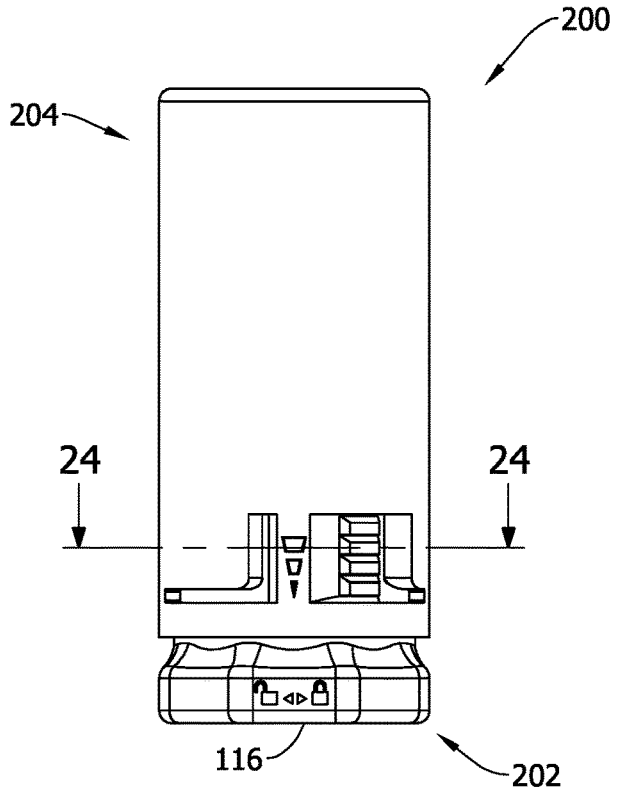
FIG. 20 is a first side elevational view of an exemplary telescoping twist and lock package in an unlocked state according to a second embodiment of the present invention.

As shown in FIG. 15, by rotating the base piece 102 in a counterclockwise direction while simultaneously rotating the cover piece 104 in a clockwise direction, the shallow angle side 164 can be resiliently deflected until the lock protrusions 118 are engaged to the lock recesses 152 as shown in FIGS. 18 and 19. In this manner, the user may not easily rotate the base piece and cover piece 102, 104 in the wrong direction at all, but may easily rotate the base piece and cover piece 102, 104 in the right direction to intuitively lock the pieces in desired positions. Also, the user may intuitively know that the package 100 has been locked via the snap-action of the package 100 as the lock positions are reached and the locking features are fully engaged.

As seen in the examples of FIGS. 18 and 19, in the circumferential direction the angles of the lock recesses 152 match the angles of the sloped end edges 124 of the locked protrusions 118. As such, once the protrusions 118 are locked in the recesses 152, the matching angles will generally resist any attempt to unlock them and inadvertent unlocking in the rotational direction is largely precluded if not eliminated. In other words, as designed the matching angles of the lock protrusions 118 and recesses 152 are intended to generally resist inadvertent and unintentional applications of force that otherwise tend to cause the protrusions 118 to become unlocked. As such, once the protrusions 118 and recesses 152 are interlocked, simple efforts to rotate the pieces in either direction will be frustrated because firm and secure locking will be obtained. As such, the locking engagement is not so easily unlocked once it has been established, so care should be taken to select the correct position before the pieces 102, 104 are locked together. Because the user can visually align the lock protrusions 118 and 150 in each of the base piece 102 and cover piece 104 before locking them in place, accidental locking in the wrong position can be easily avoided by an attentive user.

If repositioning of the cover piece 104 is necessary once it has been locked to the base piece 102, the user would have to intentionally apply a large amount of force in order to unlock the protrusions 118 to allow the cover piece 104 to be positionally readjusted to another incremental position on the lock protrusions 118 of the base piece 102 if desired. If carefully made, intentional efforts to unlock the protrusions 118 will succeed. Care should be taken to release the protrusions 118 in a manner where they return toward the axial channel 160, however, such that the shallow angle side 164 can again facilitate the deflection of the cover piece 104 to re-lock the cover piece 104 in the desired position. Otherwise, difficulty in re-locking the pieces 102, 104 could be expected.

While exemplary matching angles of the lock recesses 152 and end edges 124 of the locked protrusions 118 are illustrated, the matching angles could be varied in other embodiments. Shallower matching angles would allow locking or unlocking with reduced amounts of force while steeper matching angles would allow locking or unlocking with increased amounts of force to achieve the locked or unlocked position of the package 100. Likewise, the relative amount of force needed to lock or unlock the package could be varied by increasing or decreasing the height and depth of the lock protrusions 118 and lock recesses 124 to change the amount of deflection of the cover piece 104 needed to achieve the locked or unlocked position.

Returning back to FIGS. 9-11, a pair of anti-rocking protrusions 170 extend radially inwardly from the outer surface of the round tubular portion 140 near the distal end 144 of the cover piece 104. The anti-rocking protrusions 170 are centered respectively at 180° positions on the tubular portion 140 and are therefore located opposite to one another on the circumference of the tubular portion 140. The 180° positions of the anti-rocking protrusions 170 further reside in between the 180° positions of the interlocking portions 148. The anti-rocking protrusions 170 further include a circumferential portion and an axial portion as shown. When the lock protrusions 118 and the lock recesses 152 are engaged structural support is provided in circumferential and axial locations between the base piece 102 and the cover near the distal end 144 of the cover piece 104. Relative movement between the base piece 102 and cover piece 104 such as tilting or rocking movement is generally precluded, if not eliminated at the distal end 144 of the cover piece 104. While an exemplary shape and geometry of anti-rocking protrusions 170 are shown and described, others are possible and may be adopted with similar effect.

Considering that the base piece 102 also has anti-rocking features as described above at its own distal end 128, the assembled package 100 is doubly supported by the anti-locking features of the base piece 102 and the cover piece 104. The sturdy locked configuration with the anti-rocking features described provides a higher quality experience for the end user as well as improved reliability of the package 100 as it is subject to further handing.

The base piece 102 and cover piece 104 as described and illustrated may be respectively formed and fabricated in an integral or one-piece structure having all the features shown and described from known plastic materials according to known molded processes. The base piece 102 and cover piece 104 may be fabricated from the same or different plastic materials. The plastic material of at least the cover piece 104 appropriately exhibits some resiliency to deflect to complete the locking engagement described while still realizing a stable mechanical connection with the base piece 102 with little to no mechanical play in the locked positions. The telescoping tubular twist and lock package 100 described beneficially may be manufactured at relatively low cost with efficient structure and a highly intuitive manner of use for the end user to adjust the length of the package for optimal use a particular object to be packaged inside. Highly reliable and secure locking features are provided in the improved packages 100 that resist inadvertent changes in axial position, locking or unlocking, and the improved packages 100 are mechanically stable and sturdy to avoid rocking issues and the like to improve the user experience and further improve the package reliability.

It is recognized that while the described features of the package 100 are shown in combination in the illustrated embodiments, in some embodiments not all the features described need be present in order for meaningful benefits to be realized. For instance, and by example, only, the anti-locking features may in certain embodiments be considered optional and need not be provided. The features described may therefore be practiced separately and in combination to provide varying degrees of the benefits and advantages described.

FIGS. 20 through 28 are various views of an exemplary telescoping twist and lock package 200 according to a second embodiment of the present invention. The package 200 includes a base piece 202 and a cover piece 204 that are selectively adjustable in position relative to one another between maximum and minimum telescoping positions like the assembly 100 described above. Common features of the base piece 202 and the cover piece 204 with the base piece 102 and cover piece 204 are shown in FIGS. 20-28 with like reference characters, and the benefits of the package 100 and 200 having such common features are similar.

Figure 28:
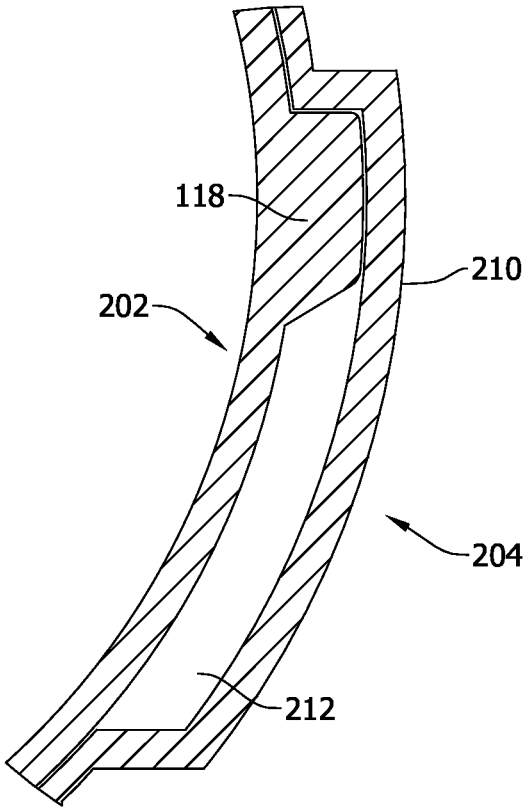
FIG. 28 is a second detail view of a portion of FIG. 26.

FIG. 28 shows the cover piece 204 assembled to the base piece 204 in an unlocked state wherein the cover piece 204 is engaged to the base piece 202, and wherein the cover piece 204 is freely slidable on the base piece 202 in an unlocked state.

Figure 21:
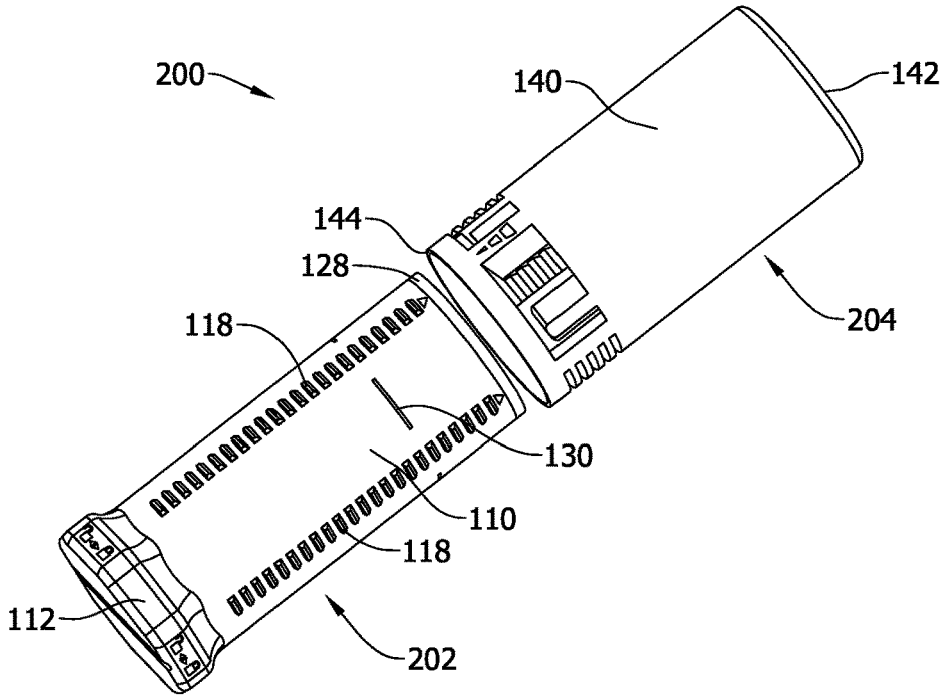
FIG. 21 is an assembly view of the telescoping twist and lock package assembly shown in FIG. 20.
Figure 22:
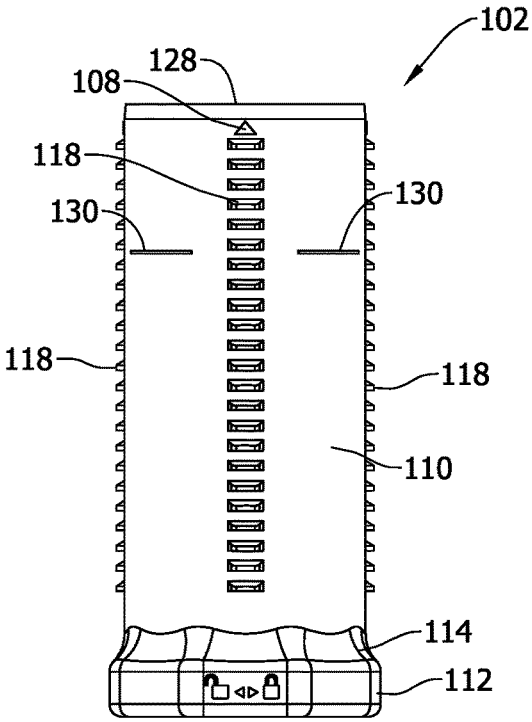
FIG. 22 is a side elevational view of the base piece for the package shown in FIGS. 20 and 21.
Figure 24:
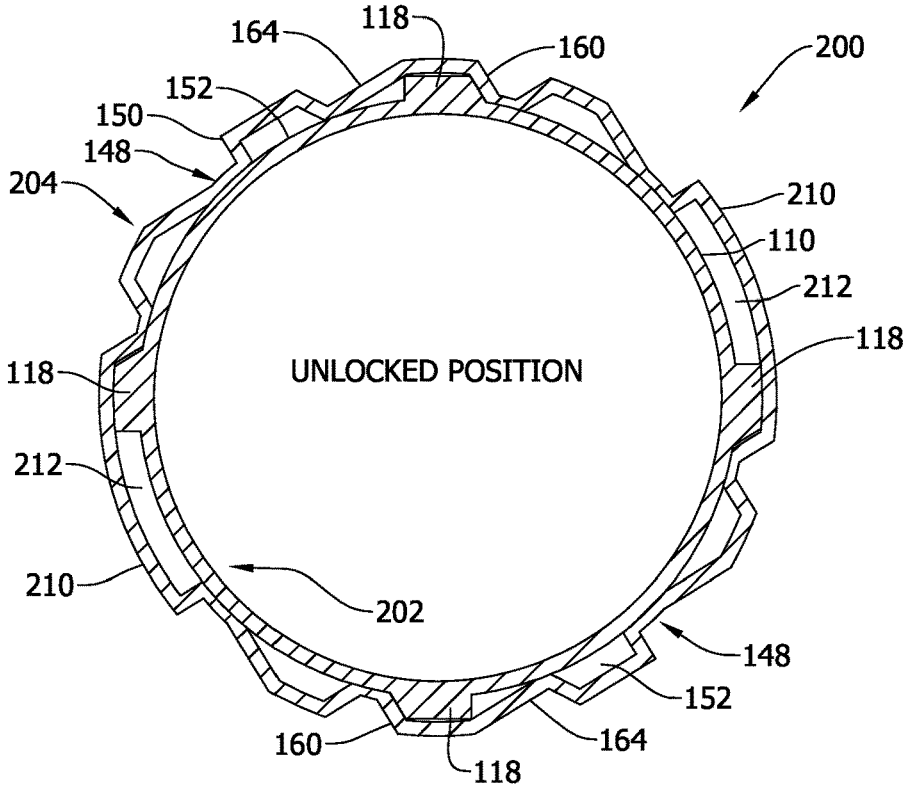
FIG. 24 is a sectional view of the package shown in FIG. 21 in the unlocked state.
Figure 25:
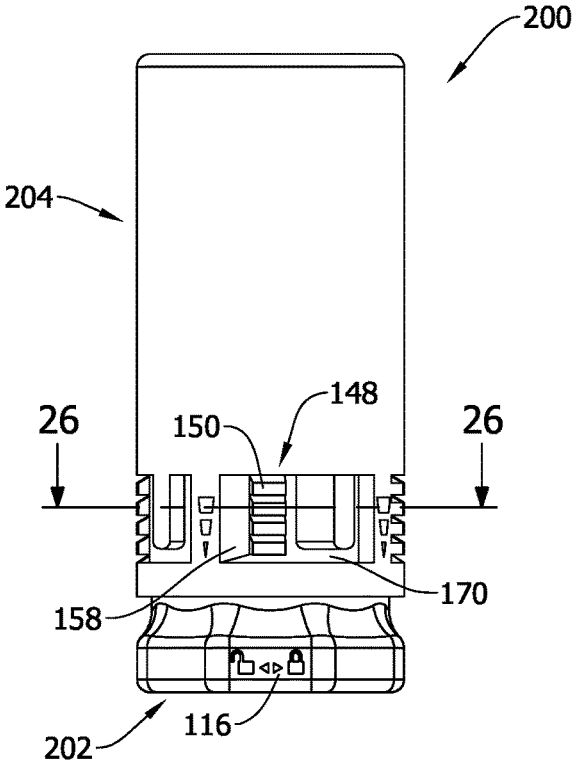
FIG. 25 is a second side elevational view of the exemplary telescoping twist and lock package shown in FIGS. 20 and 21 in a locked state.
Figure 26:
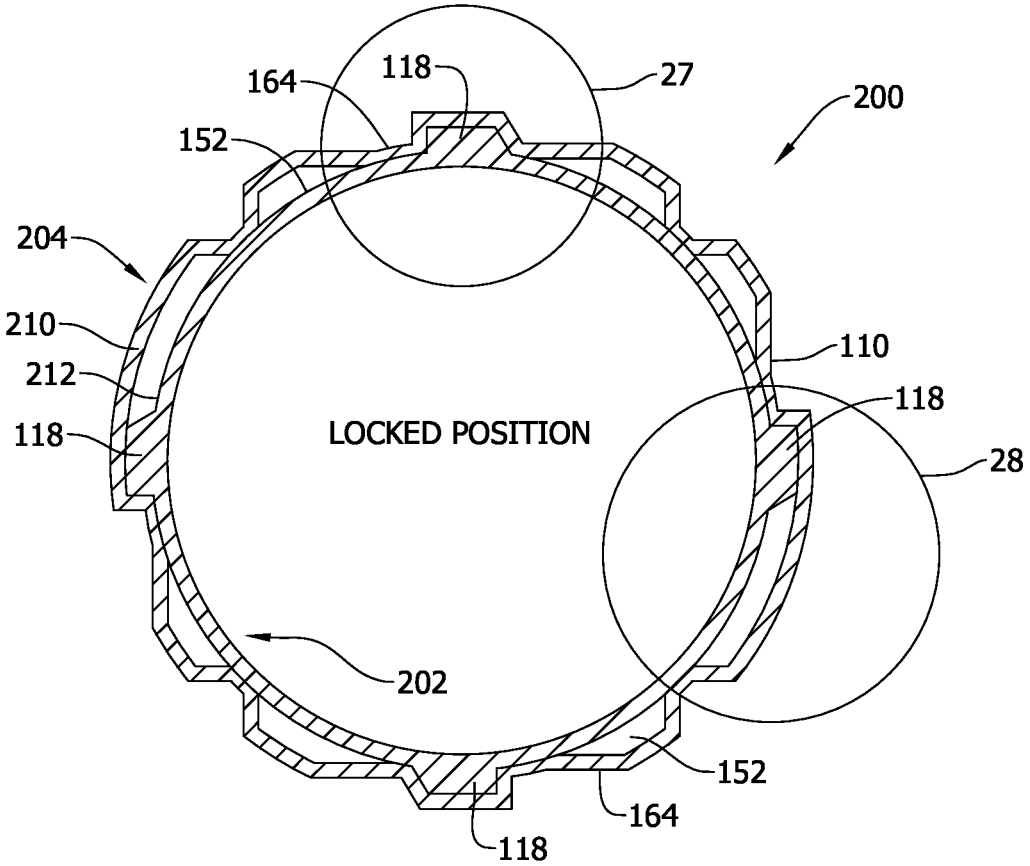
FIG. 26 is a sectional view of the package shown in FIG. 25 in the locked state

As shown in the assembly view of FIG. 21, in the side elevational view of FIG. 22, and in the sectional view of FIG. 24, the base piece 202 includes two pairs of aligned series of lock protrusions 118 which are respectively arranged as vertical columns on the round outer circumference of the tubular portion 110. The first pair of lock protrusions 118 is centered respectively at 180° positions on the outer circumference of the tubular portion 110 and therefore are located opposite to one another just above the directional arrows and lock/unlock indicators 116 in the tubular portion 110, while the second pair of lock protrusions 118 is also centered respectively at 180° positions on the outer circumference of the tubular portion 110 but centered in between the first pair of lock protrusions 118. In other words, the result of the two pairs of lock protrusions is that vertical columns of lock protrusions extend at 0°, 90°, 180° and 270° positions on the round outer circumference of the tubular portion 110. In this arrangement the second pair of aligned series of lock protrusions 118 stably supports the cover piece 204 when engaged near the distal end 128 of the base piece 102 and prevents a rocking movement in the assembled pieces 202 and 204. As such, the second pair of aligned series of lock protrusions 118 eliminates a need for the anti-rocking protrusions 126 of the base piece 102 as described above, and as such the anti-rocking protrusions 126 are omitted from the base piece 202.

Figure 23:
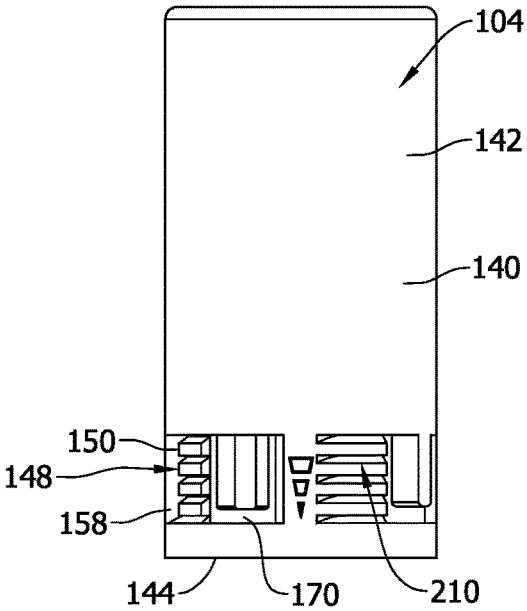
FIG. 23 is a side elevational view of the cover piece for the package shown in FIGS. 20 and 21.

As shown in the side elevational view of FIG. 23 and in the sectional view of FIG. 24, the cover piece 204 includes a first pair of recessed interlock portions 148 for mating engagement with the first pair of lock protrusions 118, and as second pair of recessed interlock portions 210 for mating engagement with the second pair of locking protrusions 118. The first pair of recessed interlock portions 148 include the exterior facing column protrusions 150 defining the internal recesses 152. Like the cover piece 102, the first pair of recessed interlock portions 148 include the guide wall 158 formed with a steep angle side 162 (FIGS. 14 and 15) on one side of the axial channel 160 and a shallow angle side 164 on the other side of the axial channel 160.

As best shown in FIG. 24, in the unlocked position of the package 200 each of the protrusions 118 are seated adjacent relatively steep side walls that serve as stop surfaces to prevent rotation of the pieces 204, 206 past the unlocked position. As such, and in the view of FIG. 24, the base piece is generally prevented from relative rotation in the cover piece 204 in the clockwise direction and/or the cover piece 204 is prevented from relative rotation on the base piece 202 in the counterclockwise direction.

In the unlocked position, however, the first pair of lock protrusions 118 are respectively freely slidable along the axis 106 of the package 200 in the channels 160, while the second pair of lock protrusions are freely slidable in axial channels 212 defined by the recessed interlock portions 210. As such, the user may adjust the relative axial positions of the base piece 102 and cover piece 204 to select a desired one of the gradated positions that is most optimal for the packaged object. Unlike the channels 160, however, the channels 212 do not include a shallow side wall that is deflectable, such that when the pieces 202, 204 are rotated relative to one another (e.g., the piece 202 rotated counterclockwise and/or the piece 204 rotated clockwise) only the walls 164 are deflected to lock the first pair of protrusions 218 in the internal recess 252 as shown in the sectional view of FIG. 26. The second pair of lock protrusions 118 in the channels 212 are freely movable without deflecting any portion of the cover piece 204. Comparing FIGS. 24 and 26, the second pair of lock protrusions 118 are moved between opposite edges of the channels 212 in the unlocked and locked positions, but are not positively locked in position in either of the locked or unlocked state.

Figure 27:
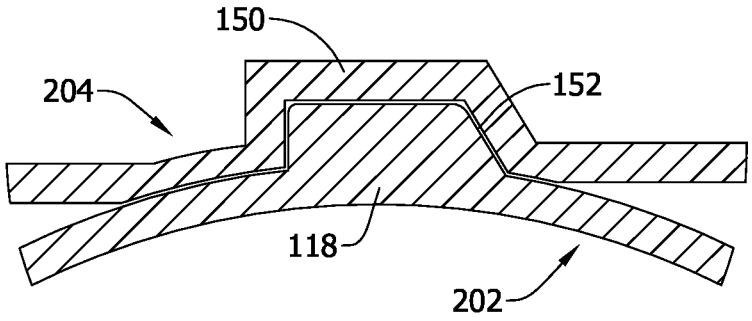
FIG. 27 is a first detail view of a portion of FIG. 26.

As shown in the detailed view of FIG. 27, the angles on the sides of the lock protrusions 118 and in the lock recesses 152 may be different from one another to provide a higher degree of resistance to rotation in a first rotational direction that in a second rotational direction opposite to the first rotational direction. This increases the degree of locking realized in the mated pieces of the package via a steeper angle that more strongly resists an unlocking of the package 200, while the shallower angle on the opposite side facilitates locking with a relatively lesser amount of force exerted by the user.

Figure 29:
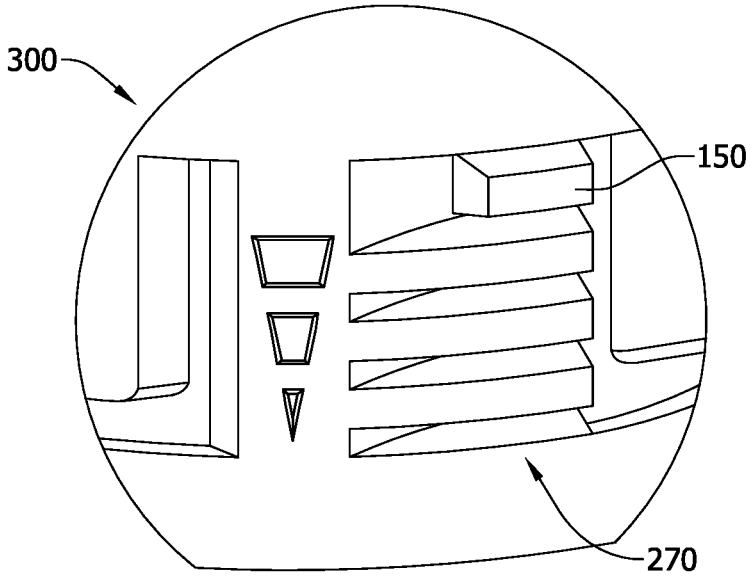
FIG. 29 is a partial view of an exemplary telescoping twist and lock package according to a third embodiment of the present invention.

FIG. 29 is a partial view of an exemplary telescoping twist and lock package 300 according to a third embodiment of the present invention. The twist and lock package 300 is an adaptation of the package 200 that includes the two pairs of locking protrusions 118.

The package assembly 300 includes a combination of the recessed interlock portions 210 and an exterior facing column protrusion 150. The protrusion 150 defines an internal locking recess 152 so that one of the second pair of locking protrusions 118 may be locked in place while the remaining of the second pair of locking protrusions 118 are not positively locked. As such, multiple ones of the first pair of locking second pair of locking protrusions 118 are positively locked as shown and described in the packages 100 and 200, while only one of the second pair of protrusions is locked in place. As such, locking is achieved at each of the four 90° positions without significantly increasing the locking force that has to be asserted by the user.

The benefits and advantages of the inventive concepts herein are now believed to have been amply demonstrated in view of the exemplary embodiments disclosed.

An embodiment of a telescoping twist and lock package has been disclosed including a base piece and a cover piece. The base piece includes an elongated smaller diameter tubular portion having a circular cross section and a first outer surface, a first series of aligned spaced apart lock protrusions arranged as a first axial column on the first outer surface, and a second series of aligned spaced apart lock protrusions arranged as a second axial column on the first outer surface, wherein the first and second axial columns are respectively centered at 180° positions on the outer circumference. The cover piece includes an elongated larger diameter tubular portion having a circular cross section and a second outer surface, and first and second contoured and recessed interlock portions extending on the second outer surface, wherein the first and second contoured and recessed interlock portions are clearly visible from vantage points outside of the cover piece. By virtue of the first and second series of aligned spaced apart lock protrusions and the first and second contoured and recessed interlock portions the base piece and cover piece are configured to be selectively assembled to one another in an adjustable telescoping relationship relative to one another in a plurality of gradated positions imparting respectively different axial length to the assembled package.

Optionally, the first and second contoured and recessed interlock portions may each include a series of exterior facing column protrusions that extend flush with the second outer surface, with each of the exterior facing column protrusions defining an internal lock recess to lockingly receive selected ones of the first or second series of lock protrusions of the base piece. Each internal lock recess may be shaped similarly to but is slightly larger than one of the lock protrusions. The first and second series of aligned spaced apart lock protrusions may also include a first number of lock protrusions and wherein the series of exterior facing column protrusions includes a second number of exterior facing column protrusions, wherein the second number is much less than the first number. The first and second contoured and recessed interlock portions may also each define an axial channel adjacent the series of exterior facing column protrusions, the axial channel receiving a respective one of the first and second series of aligned spaced apart lock protrusions, and wherein the respective one of the first and second series of aligned spaced apart lock protrusions are slidable in the axial channel to selectively engage the base piece and cover piece in one of the plurality of gradated positions.

As further options, the first and second recessed interlock portions may define a guide wall portion extending between the series of exterior facing column protrusions and the axial channel, with the guide wall defining a shallow angle side of the axial channel. Each guide wall may be resiliently deflectable along the shallow angle side of the axial channel when the base piece and cover piece are rotated relative to one another to move the first and second series of aligned spaced apart lock protrusions in a rotatable direction toward the series of exterior facing column protrusions and the internal lock recesses. The first and second recessed interlock portions may also further define a steep angle side of the axial guide channel opposite the shallow angle side.

Each internal lock recess may include steep angle sides to resist an inadvertent unlocking of the package. The cover piece may include a pair of anti-rocking protrusions extending radially inwardly from the second outer surface, and the pair of anti-rocking protrusions may be respectively centered at 180° positions on the second outer surface while also residing in between the pair of recessed interlock portions. The cover piece may likewise include a hanger portion.

The base piece may optionally include at least one guide line extending on the first outer surface as a visual reference of a most reliable upper limit for an axial position of the cover piece relative to the base piece. The base piece may also include a pair of anti-rocking protrusions extending outwardly from the first outer surface, and the pair of anti-rocking protrusions may be respectively centered at 180° positions on the first outer surface while also residing in between the first and second series of aligned spaced apart lock protrusions.

The base piece may optionally include a third series of aligned spaced apart lock protrusions arranged as a third axial column on the first outer surface and a fourth series of aligned spaced apart lock protrusions arranged as a third axial column on the first outer surface, wherein the third and fourth series of aligned spaced apart lock protrusions are respectively located in between the first and second series of aligned spaced apart lock protrusions. The cover piece may also define third and fourth recessed interlock portions extending on the second outer surface, the third and fourth recessed interlock portions receiving the third and fourth series of aligned spaced apart lock protrusions. Selected ones of the third and fourth aligned spaced apart lock protrusions may be freely movable in the third fourth recessed interlock portions between locked and unlocked positions of the package without deflecting any portion of the cover piece. The third and fourth series of lock protrusions may also define at least one lock recess to lockably receive at least one of the lock protrusions in the lock protrusions.

The base and cover piece may optionally each be provided with at least one visual indicator for reference by a person to align the base piece and cover piece, lock the base piece and cover piece in a desired position, or unlock the base piece and cover piece.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A telescoping twist and lock package comprising:

a base piece including an elongated smaller diameter tubular portion integrally formed with a first open end, a first closed end, a circular cross section and a first outer surface, a first series of aligned spaced apart lock protrusions arranged as a first axial column on the first outer surface, and a second series of aligned spaced apart lock protrusions arranged as a second axial column on the first outer surface, wherein the first and second axial columns are respectively centered at 180° positions on the first outer surface; and a cover piece including an elongated larger diameter tubular portion integrally formed with second open end, a second closed end, a circular cross section and a second outer surface, and first and second contoured and recessed interlock portions extending on the second outer surface, wherein the first and second contoured and recessed interlock portions are clearly visible from vantage points outside of the cover piece;

wherein by virtue of the first and second series of aligned spaced apart lock protrusions and the first and second contoured and recessed interlock portions, the base piece and cover piece are configured to be selectively assembled to one another in an adjustable telescoping relationship relative to one another in a plurality of gradated positions imparting respectively different axial length to the assembled base piece and cover piece in order to lockably contain objects of different axial length in an interior space defined between the first closed end and the second closed end while avoiding threaded locking features.

2. The telescoping twist and lock package of claim 1, wherein the first and second contoured and recessed interlock portions each include a series of exterior facing column protrusions that extend flush with the second outer surface, each of the exterior facing column protrusions defining an internal lock recess to lockingly receive selected ones of the first or second series of lock protrusions of the base piece.

3. The telescoping twist and lock package of claim 2, wherein each internal lock recess is shaped similarly to but is slightly larger than one of the lock protrusions.

4. The telescoping twist and lock package of claim 2, wherein the first and second series of aligned spaced apart lock protrusions each includes a first number of lock protrusions and wherein the series of exterior facing column protrusions includes a second number of exterior facing column protrusions, wherein the second number is much less than the first number.

5. The telescoping twist and lock package of claim 2, wherein each internal lock recess includes steep angle sides to resist an inadvertent unlocking of the base piece and the cover piece.

6. The telescoping twist and lock package of claim 1, wherein the cover piece further includes a pair of anti-rocking protrusions extending radially inwardly from the second outer surface.

7. The telescoping twist and lock package of claim 6, wherein the pair of anti-rocking protrusions are respectively centered at 180° positions on the second outer surface while also residing in between the pair of recessed interlock portions.

8. The telescoping twist and lock package of claim 1, wherein the cover piece includes a hanger portion.

9. The telescoping twist and lock package of claim 1, wherein the base piece further includes at least one guide line extending on the first outer surface as a visual reference of a most reliable upper limit for an axial position of the cover piece relative to the base piece.

10. The telescoping twist and lock package of claim 1, wherein the base and cover piece are each provided with at least one visual indicator for reference by a person to align the base piece and cover piece, lock the base piece and cover piece in a desired position, or unlock the base piece and cover piece.

11. A telescoping twist and lock package comprising:

a base piece including an elongated smaller diameter tubular portion having a circular cross section and a first outer surface, a first series of aligned spaced apart lock protrusions arranged as a first axial column on the first outer surface, and a second series of aligned spaced apart lock protrusions arranged as a second axial column on the first outer surface, wherein the first and second axial columns are respectively centered at 180° positions on the first outer surface; and a cover piece including an elongated larger diameter tubular portion having a circular cross section and a second outer surface, and first and second contoured and recessed interlock portions extending on the second outer surface, wherein the first and second contoured and recessed interlock portions are clearly visible from vantage points outside of the cover piece;

wherein by virtue of the first and second series of aligned spaced apart lock protrusions and the first and second contoured and recessed interlock portions, the base piece and cover piece are configured to be selectively assembled to one another in an adjustable telescoping relationship relative to one another in a plurality of gradated positions imparting respectively different axial length to the assembled base piece and cover piece;

wherein the first and second contoured and recessed interlock portions each include a series of exterior facing column protrusions that extend flush with the second outer surface, each of the exterior facing column protrusions defining an internal lock recess to lockingly receive selected ones of the first or second series of lock protrusions of the base piece; and wherein the first and second contoured and recessed interlock portions each define an axial channel adjacent the series of exterior facing column protrusions, the axial channel receiving a respective one of the first and second series of aligned spaced apart lock protrusions, and wherein the respective one of the first and second series of aligned spaced apart lock protrusions are slidable in the axial channel to selectively engage the base piece and cover piece in one of the plurality of gradated positions.

12. The telescoping twist and lock package of claim 11, wherein the first and second recessed interlock portions each further defines a guide wall portion extending between the series of exterior facing column protrusions and the axial channel, the guide wall defining a shallow angle side of the axial channel.

13. The telescoping twist and lock package of claim 12, wherein each guide wall is resiliently deflectable along the shallow angle side of the axial channel when the base piece and cover piece are rotated relative to one another to move the first and second series of aligned spaced apart lock protrusions in a rotatable direction toward the series of exterior facing column protrusions and the internal lock recesses.

14. The telescoping twist and lock package of claim 13, wherein the first and second recessed interlock portions each further define a steep angle side of the axial channel opposite the shallow angle side.

15. A telescoping twist and lock package comprising:

a base piece including an elongated smaller diameter tubular portion having a circular cross section and a first outer surface, a first series of aligned spaced apart lock protrusions arranged as a first axial column on the first outer surface, and a second series of aligned spaced apart lock protrusions arranged as a second axial column on the first outer surface, wherein the first and second axial columns are respectively centered at 180° positions on the first outer surface; and a cover piece including an elongated larger diameter tubular portion having a circular cross section and a second outer surface, and first and second contoured and recessed interlock portions extending on the second outer surface, wherein the first and second contoured and recessed interlock portions are clearly visible from vantage points outside of the cover piece;

wherein by virtue of the first and second series of aligned spaced apart lock protrusions and the first and second contoured and recessed interlock portions, the base piece and cover piece are configured to be selectively assembled to one another in an adjustable telescoping relationship relative to one another in a plurality of gradated positions imparting respectively different axial length to the assembled base piece and cover piece;

wherein the base piece further includes a pair of anti-rocking protrusions extending outwardly from the first outer surface; and wherein the pair of anti-rocking protrusions are respectively centered at 180° positions on the first outer surface while also residing in between the first and second series of aligned spaced apart lock protrusions.

16. The telescoping twist and lock package of claim 1, wherein the base piece further includes a third series of aligned spaced apart lock protrusions arranged as a third axial column on the first outer surface and a fourth series of aligned spaced apart lock protrusions arranged as a fourth axial column on the first outer surface, wherein the third and fourth series of aligned spaced apart lock protrusions are respectively located in between the first and second series of aligned spaced apart lock protrusions.

17. The telescoping twist and lock package of claim 16, wherein the cover piece further defines third and fourth recessed interlock portions extending on the second outer surface, the third and fourth recessed interlock portions receiving the third and fourth series of aligned spaced apart lock protrusions.

18. The telescoping twist and lock package of claim 17, wherein selected ones of the third and fourth aligned spaced apart lock protrusions are freely movable in the third and fourth recessed interlock portions between locked and unlocked positions of the package without deflecting any portion of the cover piece.

19. The telescoping twist and lock package of claim 18, wherein the third and fourth series of recessed interlock portions further defines at least one internal lock recess to lockably receive at least one of the lock protrusions in the third and fourth aligned spaced apart lock protrusions.

* * * * *